US008371800B2

(12) United States Patent
Meenakshisundaram et al.

(10) Patent No.: US 8,371,800 B2
(45) Date of Patent: Feb. 12, 2013

(54) COOLING GAS TURBINE COMPONENTS WITH SEAL SLOT CHANNELS

(75) Inventors: Ravichandran Meenakshisundaram, Greenville, SC (US); Yang Liu, Greenville, SC (US)

(73) Assignee: General Electric Company, Schenectady, NY (US)

( * ) Notice: Subject to any disclaimer, the term of this patent is extended or adjusted under 35 U.S.C. 154(b) by 581 days.

(21) Appl. No.: 12/716,784

(22) Filed: Mar. 3, 2010

(65) Prior Publication Data

US 2011/0217155 A1 Sep. 8, 2011

(51) Int. Cl.
*F01D 25/08* (2006.01)
*F01D 5/08* (2006.01)

(52) U.S. Cl. ..... 415/1; 415/110; 415/115; 415/139; 415/173.4; 415/191

(58) Field of Classification Search ..... 415/1, 110, 415/115, 116, 139, 171.1, 173.1, 173.4, 191
See application file for complete search history.

(56) References Cited

U.S. PATENT DOCUMENTS

| | | | | |
|---|---|---|---|---|
| 4,902,198 | A | 2/1990 | North | |
| 5,531,457 | A * | 7/1996 | Tibbott et al. | 415/115 |
| 6,340,285 | B1 * | 1/2002 | Gonyou et al. | 415/116 |
| 6,354,795 | B1 | 3/2002 | White et al. | |
| 6,491,093 | B2 * | 12/2002 | Kreis et al. | 415/138 |
| 7,033,138 | B2 * | 4/2006 | Tomita et al. | 415/139 |
| 7,097,429 | B2 | 8/2006 | Athans et al. | |
| 7,121,802 | B2 | 10/2006 | Athans et al. | |
| 7,163,376 | B2 | 1/2007 | Itzel et al. | |
| 7,217,081 | B2 * | 5/2007 | Scheurlen et al. | 415/1 |
| 7,231,724 | B2 | 6/2007 | Sherlock et al. | |
| 7,309,212 | B2 | 12/2007 | Itzel et al. | |
| 7,416,391 | B2 | 8/2008 | Veltre et al. | |
| 7,520,715 | B2 | 4/2009 | Durocher et al. | |
| 7,524,163 | B2 * | 4/2009 | Self et al. | 415/115 |
| 7,625,172 | B2 | 12/2009 | Walz et al. | |
| 2003/0082046 | A1 | 5/2003 | Nigmatulin | |
| 2005/0111965 | A1 | 5/2005 | Lowe et al. | |
| 2005/0152777 | A1 | 7/2005 | Thompson | |
| 2008/0206042 | A1 | 8/2008 | Lee et al. | |

FOREIGN PATENT DOCUMENTS

| | | | |
|---|---|---|---|
| EP | 1162346 | A2 | 12/2001 |
| EP | 1621736 | A2 | 2/2006 |
| EP | 2239418 | A2 | 10/2010 |
| GB | 2432888 | A | 6/2007 |
| JP | 2009257281 | A | 11/2009 |
| WO | 9618025 | A1 | 6/1996 |

OTHER PUBLICATIONS

European Search Report and Written Opinion issued Jun. 22, 2011 in connection with corresponding EP Application No. 11156672.5.

* cited by examiner

*Primary Examiner* — Igor Kershteyn
(74) *Attorney, Agent, or Firm* — Nixon & Vanderhye, P.C.

(57) ABSTRACT

A segment of a component for use in a gas turbine includes a leading edge; a trailing edge; a pair of opposed lateral sides between the leading and trailing edges; and a seal slot provided in each lateral side. The seal slot includes a surface having a channel extending in an axial direction defined from the leading edge to the trailing edge, at least one inlet to the channel, and at least one outlet from the channel. The at least one outlet is spaced downstream from the at least one inlet in the axial direction. The segment may be an inner shroud segment or a nozzle segment.

19 Claims, 6 Drawing Sheets

COOLING GAS TURBINE COMPONENTS WITH SEAL SLOT CHANNELS

The present invention relates to shrouds and nozzles for gas turbines and, more particularly, to arrangements for cooling shrouds and nozzles of gas turbines.

BACKGROUND OF THE INVENTION

Shrouds employed in a gas turbine surround and in part define the hot gas path through the turbine. Shrouds are typically characterized by a plurality of circumferentially extending shroud segments arranged about the hot gas path, with each segment including discrete inner and outer shroud bodies. Conventionally, there are two or three inner shroud segments for each outer shroud segment, with the outer shroud segments being secured to the stationary inner shell or casing of the turbine and the inner shroud segments being secured to the outer shroud segments. The inner shroud segments directly surround the rotating parts of the turbine, i.e., the rotor wheels carrying rows of buckets or blades.

Because the inner shroud segments are exposed to hot combustion gases in the hot gas path, systems for cooling the inner shroud segments are oftentimes necessary to reduce the temperature of the segments. This is especially true for inner shroud segments in the first and second stages of a turbine that are exposed to very high temperatures of the combustion gases due to their close proximity to the turbine combustors. Heat transfer coefficients are also very high due to rotation of the turbine buckets or blades.

To cool the shrouds, typically relatively cold air from the turbine compressor is supplied via convection cooling holes that extend through the segments and into the gaps between the segments to cool the sides of the segments and to prevent hot path gas ingestion into the gaps. The area that is purged and cooled by a single cooling hole is small, however, because the velocity of the cooling air exiting the cooling hole is high and the cooling air diffuses into the hot gas flow path.

Typically, the post-impingement air leaks into the gas path between two inner shrouds, through hard/cloth seals located on the seal slot surface. Shroud slash faces, in particular, above the bucket region, are the life-limiting regions, mainly due to oxidation. This is caused by the continuous ingestion of hot gases thrown by the bucket towards the shroud inter-segment gaps. Traditional cooling methods use cooling holes along the slash face drilled from post-impingement cold section, or discrete perpendicular channels machined along the length of the seal slot, which improves the slash face cooling to certain extent, but whose effects are very localized as they do not cover the entire length of low-life slash face region.

Another component of gas turbines that includes seal slots are nozzles. A nozzle may be formed by a plurality of sections, or segments, and seals between adjacent segments. Service run nozzles in a gas turbine may have distorted sidewalls as a result of previous weld repairs or due to stress relief during service. Creep strain due to applied loads at operating temperatures may also contribute to distortion. This movement of the sidewalls will cause the seal slots that are contained within the sidewalls to be out of position relative to engine center.

If the sidewalls are not pressed back into position, the seal slots between adjacent segments would not be aligned with each other, and it may prove impossible to fit the seals in place. Alternatively, it may be possible to force the seals into the slots but this would lock the nozzle segments together such that they could not move or "float" relative to each other. This float is necessary to allow for thermal expansion and to ensure the segments load up against the sealing faces (hook fit and chordal hinge) during operation. If they are locked together, it is likely they will be skewed and will not load against their sealing faces. This will result in compressor discharge air leaking directly into the hot gas path and will reduce the amount of air available for combustion and for cooling of the nozzle. The result of reduced air for combustion will be lower performance of the turbine and increased emissions. A reduction in available cooling air will result in increased oxidation of the nozzle due to a resultant higher metal temperature and the lack of cooling will also cause changes to thermal gradients within the nozzle leading to increased cracking of the part. This will increase subsequent repair costs and may reduce the life of the parts.

Misaligned sidewalls may also result in flow path steps. The hot gas will not have a smooth path but will be tripped by the mismatch between adjacent nozzle segments, resulting in turbulent flow and reduced energy of the gas stream, thereby reducing performance. Turbulent flow also increases thermal transfer to the nozzle and so will raise the metal temperature, leading to increased oxidation and cracking.

BRIEF DESCRIPTION OF THE INVENTION

According to one embodiment, a segment of a component for use in a gas turbine comprises a leading edge; a trailing edge; a pair of opposed lateral sides between the leading and trailing edges; and a seal slot provided in each lateral side. The seal slot comprises a surface having a channel extending in an axial direction defined from the leading edge to the trailing edge, at least one inlet to the channel, and at least one outlet from the channel, wherein the at least one outlet is spaced downstream from the at least one inlet in the axial direction.

According to another embodiment, a gas turbine comprises at least one of an inner shroud and a nozzle, wherein at least one of the inner shroud and the nozzle comprises a plurality of circumferentially arranged segments, and each segment comprises a leading edge, a trailing edge, a pair of opposed lateral sides between the leading and trailing edges; and a seal slot provided in each lateral side, the seal slot comprising a surface, the surface comprising a channel extending in an axial direction defined from the leading edge to the trailing edge, at least one inlet to the channel, and at least one outlet from the channel, wherein the at least one outlet is spaced downstream from the at least one inlet in the axial direction.

According to yet another embodiment, a method of cooling a component of a gas turbine is provided. The component comprises a plurality of segments circumferentially arranged. Each segment comprises a leading edge, a trailing edge, a pair of opposed lateral sides between the leading and trailing edges, and a seal slot provided in each lateral side. The component further comprises a seal on each seal slot. The method comprises directing cooling air that leaks into the seal slot below the seal through at least one inlet into a channel formed in a surface of the seal slot, wherein the channel extends in an axial direction defined from the leading edge to the trailing edge; directing the leaking cooling air along the channel; and directing the leaking cooling air out of the channel through at least one outlet, wherein the at least one outlet is spaced downstream from the at least one inlet in the axial direction.

DETAILED DESCRIPTION OF THE INVENTION

Figure 1:
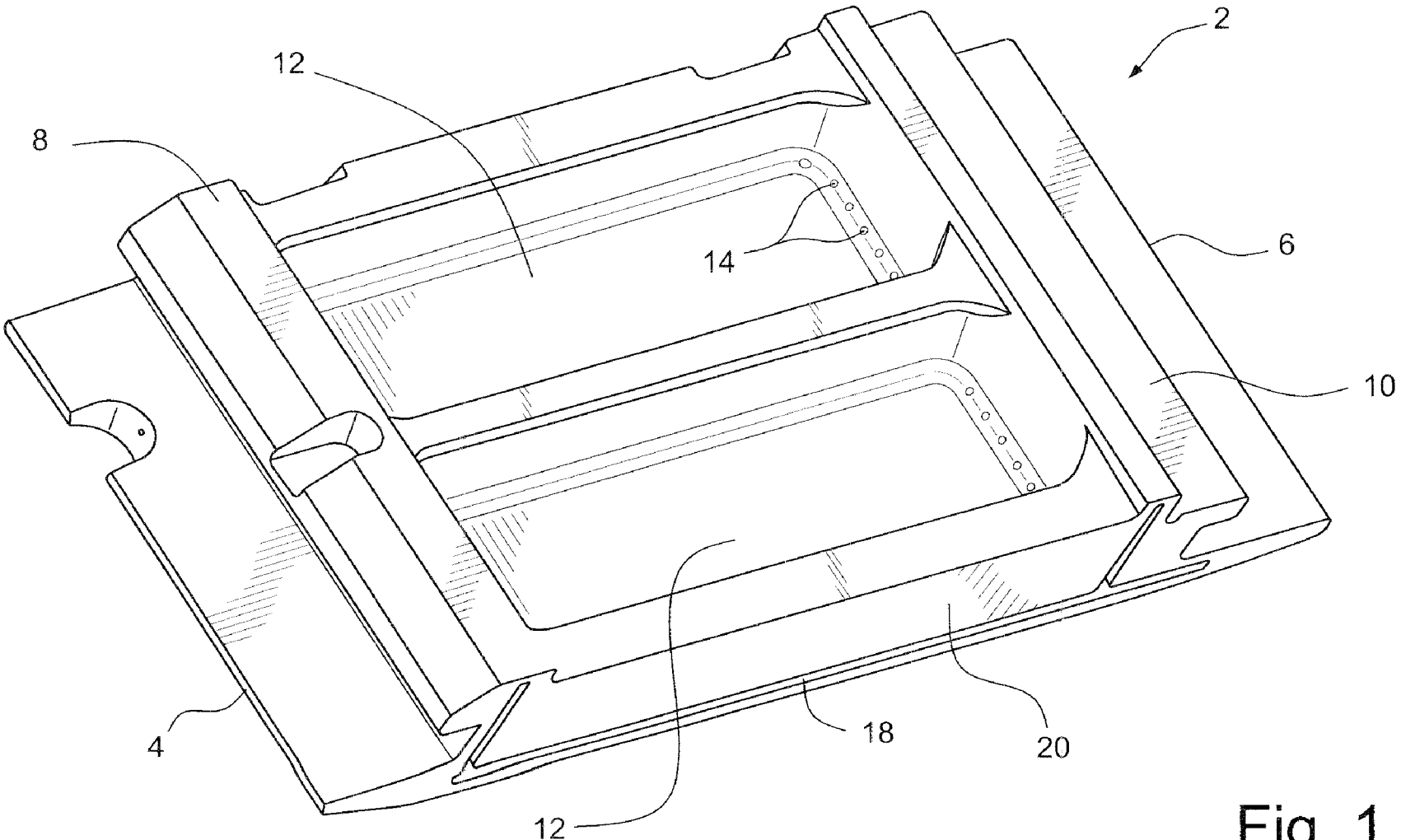
FIG. 1 is a front perspective view of an inner shroud segment.
Figure 2:
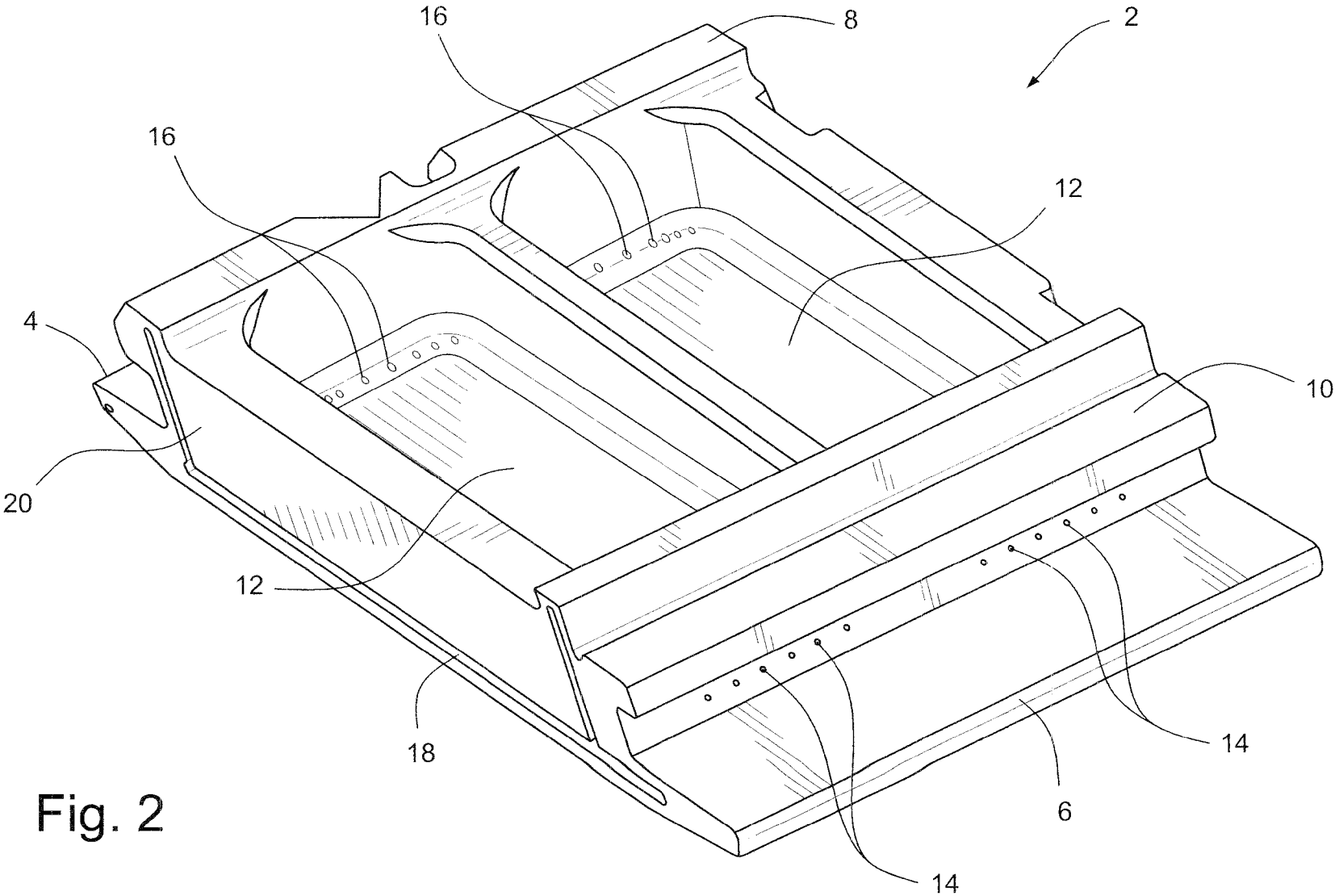
FIG. 2 is a rear perspective of the inner shroud segment of FIG. 1.
Figure 3:
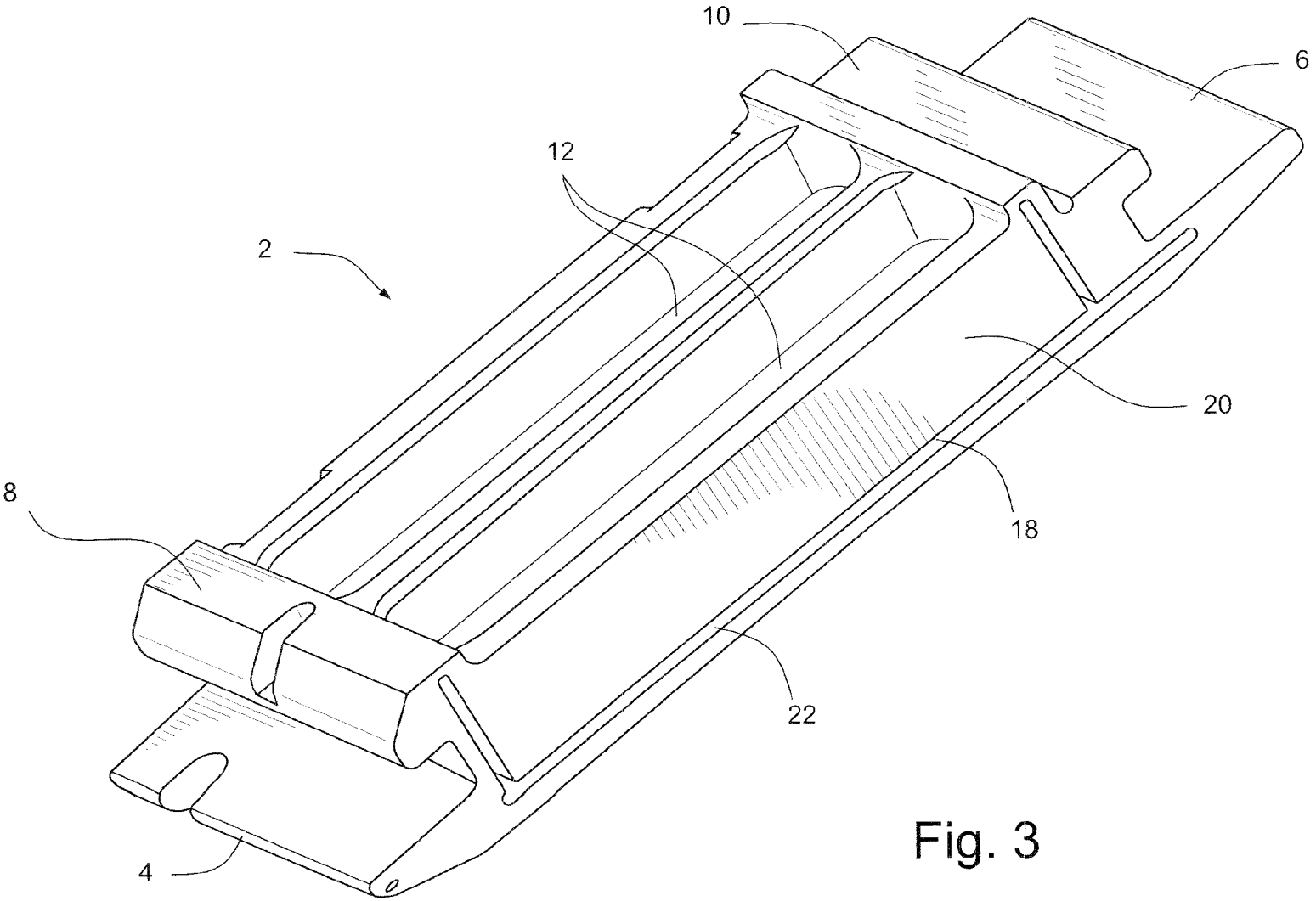
FIG. 3 is a side perspective of the inner shroud segment of FIGS. 1 and 2.

Referring to FIGS. 1-3, an inner shroud segment 2 comprises a leading edge 4 and a trailing edge 6. The inner shroud segment 2 is configured to be connected to an outer shroud segment by a leading edge hook 8 and a trailing edge hook 10.

The inner shroud segment 2 comprises impingement cavities, or plenums, 12 which receive relatively cold air from the turbine compressor to cool the inner shroud segments. As shown in FIG. 1, trailing edge convection cooling apertures 14 extend through the inner shroud segment 2, and as shown in FIG. 2, leading edge convection cooling apertures 16 are provided adjacent the leading edge 4.

Referring still to FIGS. 1-3, the inner shroud segment 2 may comprise a seal slot 18 configured to receive a hard/cloth seal located on the seal slot surface 22. Typically, the post-impingement air leaks into the gas path between two inner shroud segments and through the hard/cloth seals located on the seal slot surface 22. The post-impingement leakage/cooling air enters the seal slot 18 below the hard/cloth seals on the seal slots 18 and exits into the hot gas path, thus providing active cooling closer to the slash faces 20 of the inner shroud segments. The slash faces 20 are provided on opposed lateral sides of the inner shroud segment 2.

Figure 4:
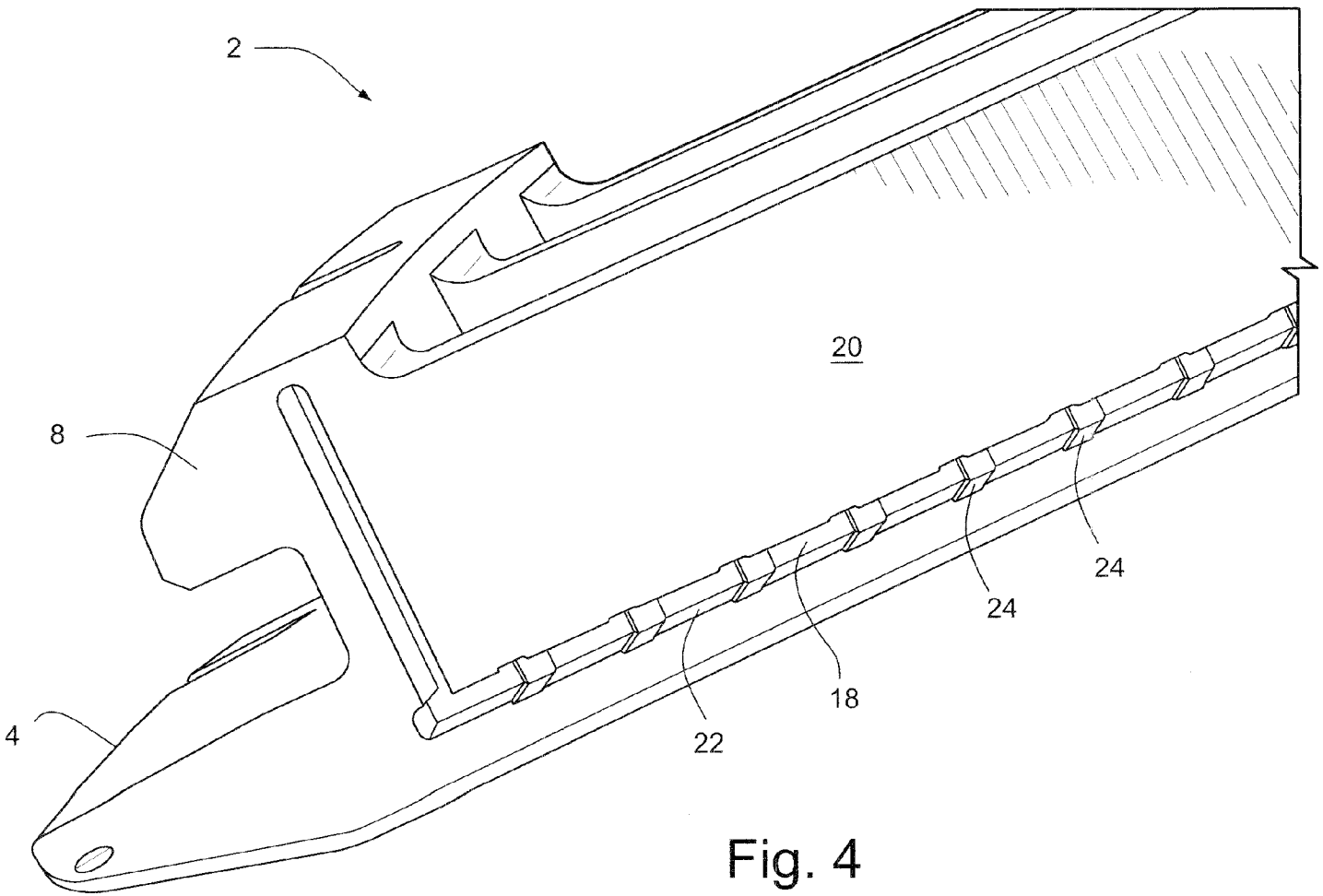
FIG. 4 is a side perspective of another inner shroud segment.

Referring to FIG. 4, discrete channels 24 are provided in the seal slot surface 22. The post-impingement leakage/cooling air enters perpendicular inlet channels 24 below the hard/cloth seals on the seal slots 18 and provides active cooling to the slash face 20. As used herein, the term perpendicular refers to a direction perpendicular to the axial direction of the inner shroud segment defined from the leading edge to the trailing edge in a direction from an upstream position to a downstream position of a hot gas path through the turbine shroud. The cooling provided by the inlet channels 24 is localized and does not cover the entire length of the slash face region.

Figure 5:
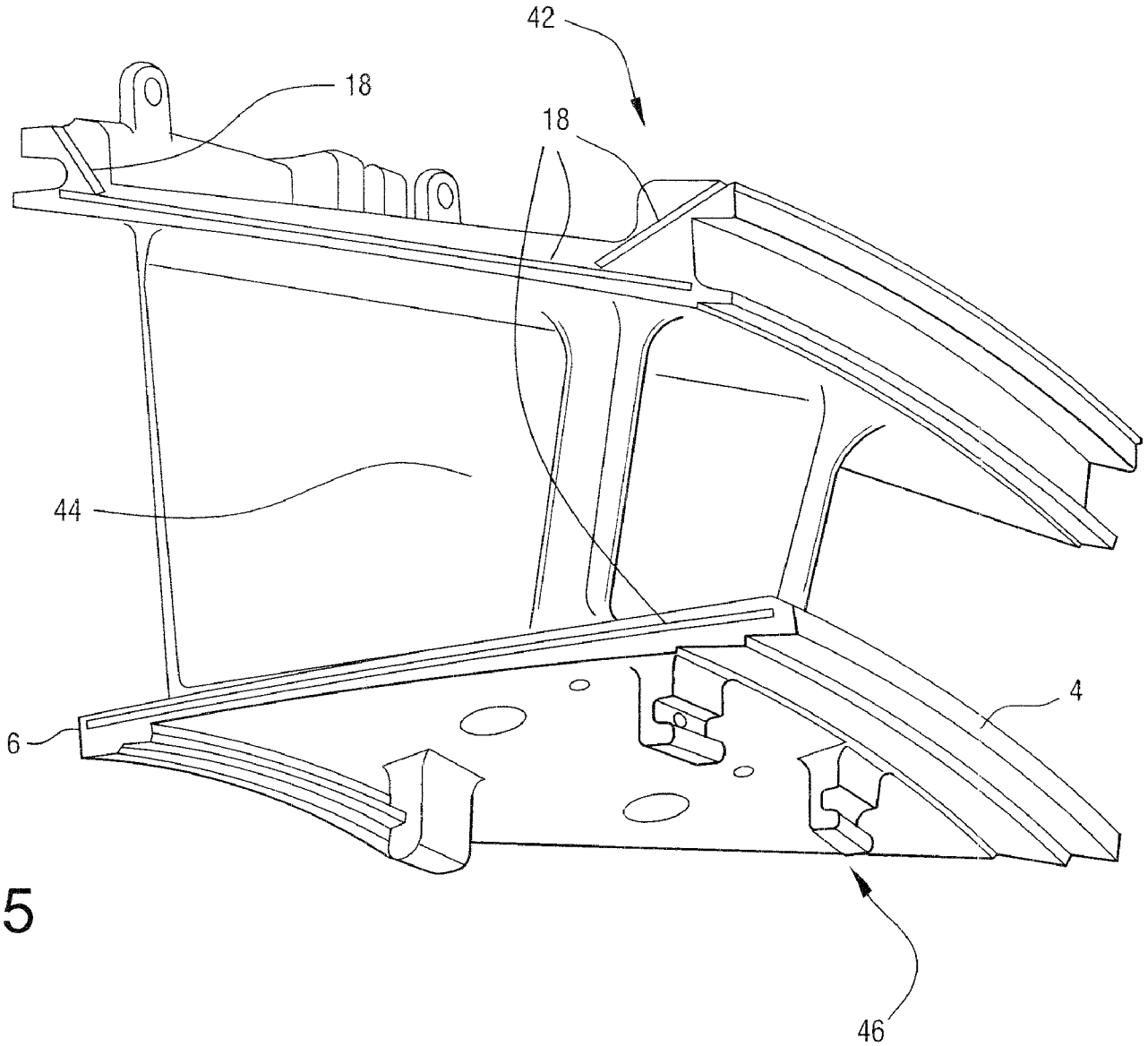
FIG. 5 is a perspective view of a gas turbine nozzle section.

Referring to FIG. 5, a section or segment of a gas turbine nozzle includes an outer wall 42, an inner wall 46, and an airfoil 44 between the walls 42, 46. The nozzle segment includes a leading edge 4 and a trailing edge 6. The section also includes a number of seal slots 18 provided in opposed lateral sides of the nozzle segment. The seal slots 18 retain the end face seals (sometimes referred to as spline seals or slash face seals) that seal between adjacent nozzle segments and prevent the compressor discharge air leaking into the hot gas path and prevent ingestion of hot gas into the component.

Figure 6:
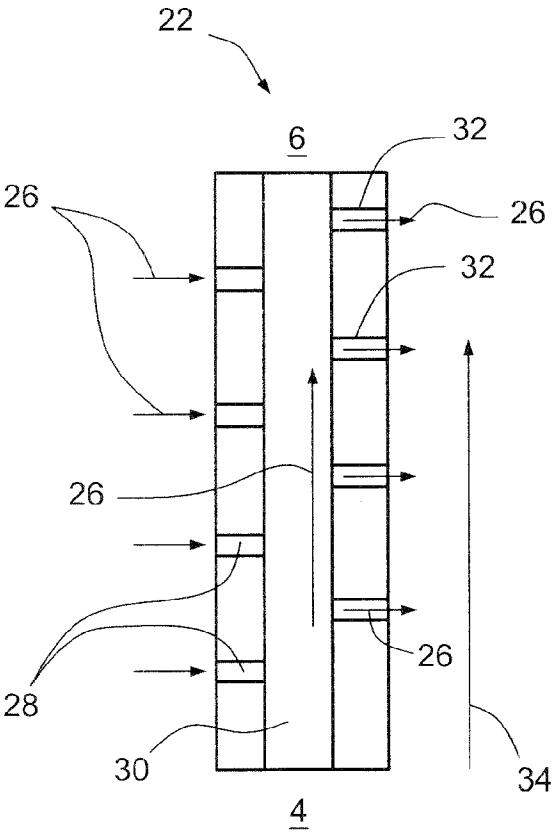
FIG. 6 is a plan view of a seal slot surface according to an embodiment of the invention.

Referring to FIG. 6, according to an embodiment of the invention, the seal slot surface 22 comprises a plurality of perpendicular inlet channels 28. The post-impingement leakage/cooling air 26 enters the multiple perpendicular inlet channels 28 and then flows axially in a channel 30, and then enters perpendicular exit channels 32 into the hot gas path 34. As used herein, the term axial refers to the direction of the inner shroud segment from the leading edge to the trailing edge in a direction from an upstream position to a downstream position of the hot gas path through the turbine.

As shown in FIG. 6, the exit channels 32 are located alternately from the inlet channels 28. This configuration reduces the possibility that combustion gases from the hot gas path 34 may enter the seal slot of the inner shroud segment. It should be appreciated, however, that the inlet channels 28 and the exit channels 32 may be coaxial to each other. It should also be appreciated that the inlet channels 28 and/or the outlet channels 32 may not be perpendicular to the axial channel 30, but may instead be provided at an angle to the axial channel 30. It should be further appreciated that the number of inlet channels may be different from the number of outlet channels, or that the widths and/or lengths of the inlet channels and/or the outlet channels may be different from each other.

Figure 7:
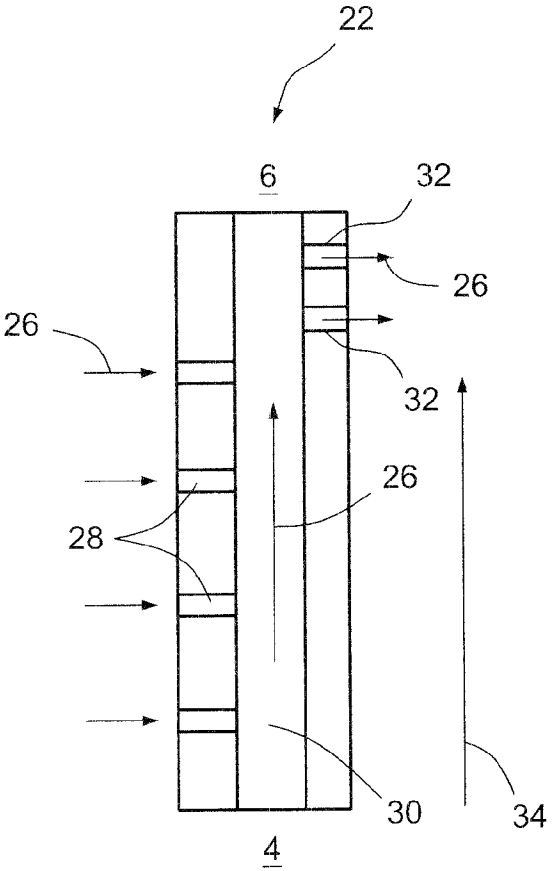
FIG. 7 is a plan view of a seal slot surface according to another embodiment of the invention.

Referring to FIG. 7, a seal slot surface 22 according to another embodiment comprises a plurality of perpendicular inlet channels 28. The post-impingement leakage/cooling air 26 enters the inlet channels 28 and flows into the channel 30 and then flows out the perpendicular exit channels 32 into the hot gas path 34. As shown in FIG. 7, the exit channels 32 are provided after the inlet channels 28 in the axial direction of the seal slot surface 22. This configuration provides robust cooling in cases where the leading edge backflow margin is low because it prevents hot gases from short-circuiting through the exit channels 32 near the leading edge of the segment.

Figure 8:
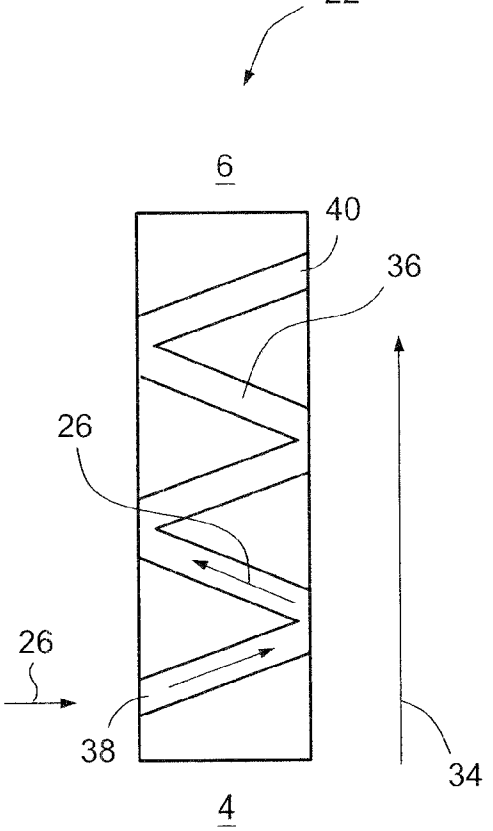
FIG. 8 is a plan view of a seal slot surface according to a further embodiment of the invention.

Referring to FIG. 8, a seal slot surface 22 according to another embodiment includes a channel 36. The leakage/cooling air 26 enters the channel at inlet 38 and exits the channel 36 at outlet 40. The channel 36 may take a zig-zag configuration in the seal slot surface 22. Alternatively to, or in combination with, the zig-zag configuration, the channel may include a serpentine configuration Although each portion, or segment, of the channel 36 is shown as linear in FIG. 8, it should be appreciated that the portions, or segments, may be curved, or curvilinear. The configuration of FIG. 8 provides an increased convection path length compared to the embodiments shown in FIGS. 6 and 7.

The channels 30, 36 shown in the embodiments of FIGS. 6-8 provide continuous convective cooling of the seal slot surface 22 closer to the hot surface of the slash face. By providing continuous partial or full length axial convective cooling, the heat transfer coefficient of the post-impingement leakage/cooling air is increased and effective cooling closer to the hot slash face can be achieved. Continuous partial or full length axial convective cooling closer to the hot metal helps to cool the slash face, thus increasing the mechanical life of the inner shroud and/or nozzle segments. As more cooling is provided to the shroud and/or nozzle low life regions, in particular to the slash face length of the shroud segment above the bucket region of the turbine, it is possible to achieve higher mechanical life.

The seal slot surfaces of the embodiments shown in FIGS. 6-8 may be cast with the seal slot of the inner shroud segment or nozzle segment. It should also be appreciated that the embodiments of the seal slot surface 22 shown in FIGS. 6-8 may be formed by electro-discharge machining of the seal slot surface of an inner shroud or nozzle segment. Existing shroud and/or nozzle segments may thus be modified to include seal slot surfaces having continuous axial channels and an inlet(s) and an outlet(s).

The cooling flow along the seal slot channels can be used to cool the slash face metal temperature below certain temperature requirement, resulting in a more uniform metal temperature distribution. By providing continuous partial or full length axial convective cooling, effective cooling closer to the hot slash face can be achieved. The reduction in slash face temperature can increase shroud and nozzle part intervals and achieve higher mechanical life. Since the life-limiting region of the shroud and/or nozzle is targeted, higher mechanical life can be achieved with the increase of HGP intervals.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A segment of a component for use in a gas turbine engine, the segment comprising:

a leading edge;

a trailing edge;

a pair of opposed lateral sides between the leading and trailing edges; and a seal slot provided in each lateral side, the seal slot comprising a surface, the surface comprising a channel extending in an axial direction defined from the leading edge to the trailing edge, at least one inlet to the channel, and at least one outlet from the channel, wherein the at least one outlet is spaced downstream from the at least one inlet in the axial direction.

2. A segment according to claim 1, wherein the channel extends a full axial length of the seal slot surface.

3. A segment according to claim 1, wherein the at least one inlet comprises at least one inlet channel and the at least one outlet comprises at least one outlet channel.

4. A segment according to claim 3, wherein at least one of the at least one inlet channel and the at least one outlet channel is perpendicular to the channel.

5. A segment according to claim 1, wherein the at least one outlet comprises a plurality of outlets and the least one inlet comprises a plurality of inlets, and the plurality of outlets are axially offset from the plurality of inlets.

6. A segment according to claim 1, wherein the at least one outlet comprises a plurality of outlets and the at least one inlet comprises a plurality of inlets, and all of the outlets are axially downstream of all of the inlets.

7. A segment according to claim 1, wherein the axial channel comprises at least one of a zig-zag and a serpentine shape.

8. A segment according to claim 1, wherein the segment comprises an inner shroud segment.

9. A segment according to claim 1, wherein the segment comprises a nozzle segment.

10. A gas turbine engine, comprising:

at least one of an inner shroud and a nozzle, wherein at least one of the inner shroud and the nozzle comprises a plurality of circumferentially arranged segments, and each segment comprises a leading edge, a trailing edge, a pair of opposed lateral sides between the leading and trailing edges, and a seal slot provided in each lateral side, the seal slot comprising a surface, the surface comprising a channel extending in an axial direction defined from the leading edge to the trailing edge, at least one inlet to the channel, and at least one outlet from the channel, wherein the at least one outlet is spaced downstream from the at least one inlet in the axial direction.

11. A method of cooling a component of a gas turbine engine, the component comprising a plurality of segments circumferentially arranged, each segment comprising a leading edge, a trailing edge, a pair of opposed lateral sides between the leading and trailing edges, and a seal slot provided in each lateral side, the component further comprising a seal on each seal slot, the method comprising:

directing cooling air that leaks into the seal slot below the seal through at least one inlet into a channel formed in a surface of the seal slot, wherein the channel extends in an axial direction defined from the leading edge to the trailing edge;

directing the leaking cooling air along the channel; and directing the leaking cooling air out of the channel through at least one outlet, wherein the at least one outlet is spaced downstream from the at least one inlet in the axial direction.

12. A method according to claim 11, wherein the channel extends a full axial length of the seal slot surface.

13. A method according to claim 11, wherein the at least one inlet comprises at least one inlet channel and the at least one outlet comprises at least one outlet channel.

14. A method according to claim 13, wherein at least one of the at least one inlet channel and the at least one outlet channel is perpendicular to the axial channel.

15. A method according to claim 11, wherein the at least one outlet comprises a plurality of outlets and the least one inlet comprises a plurality of inlets, and the plurality of outlets are axially offset from the plurality of inlets.

16. A method according to claim 11, wherein the at least one outlet comprises a plurality of outlets and the at least one inlet comprises a plurality of inlets, and all of the outlets are axially downstream of all of the inlets.

17. A method according to claim 11, wherein the axial channel comprises at least one of a zig-zag and a serpentine shape.

18. A method according to claim 11, wherein the segment comprises an inner shroud segment.

19. A method according to claim 11, wherein the segment comprises a nozzle segment.

* * * * *